US006446859B1

(12) United States Patent
Holladay

(10) Patent No.: US 6,446,859 B1
(45) Date of Patent: Sep. 10, 2002

(54) FOLDABLE STORAGE CONTAINER

(76) Inventor: John Thomas Holladay, 36 Fox Den Cove, Jackson, TN (US) 38305-8932

( * ) Notice: Subject to any disclaimer, the term of this patent is extended or adjusted under 35 U.S.C. 154(b) by 0 days.

(21) Appl. No.: 09/798,670

(22) Filed: Mar. 2, 2001

(51) Int. Cl.[7] ..... B65D 5/00; B65D 5/56

(52) U.S. Cl. ..... 229/109; 229/125.28; 229/117.16; 229/117.17; 229/125.32

(58) Field of Search ..... 229/109, 125.28, 229/125.17, 125.32, 185, 117.3, 117.03, 117.16, 117.17, 4.5; 206/521.6, 524.5

(56) References Cited

U.S. PATENT DOCUMENTS

| | | | | | |
|---|---|---|---|---|---|
| 518,898 | A | | 4/1894 | Schimdt | |
| 1,497,671 | A | | 6/1924 | Crowell | |
| 1,585,505 | A | | 5/1926 | McIndoe | |
| 1,647,581 | A | * | 11/1927 | Redemski | 229/117.16 X |
| 1,935,904 | A | * | 11/1933 | Eggebrecht | 229/125.17 |
| 1,965,215 | A | * | 7/1934 | Boeye | 229/185 X |
| 2,241,710 | A | * | 5/1941 | Lowey | 229/125.17 X |
| 2,565,188 | A | * | 8/1951 | Welshenbach | 229/109 X |
| 2,711,851 | A | | 6/1955 | Rabby | |
| 2,726,803 | A | * | 12/1955 | Ketler | 229/109 X |
| 2,736,485 | A | | 2/1956 | Rabby | |
| 3,032,254 | A | * | 5/1962 | Wilson | 229/108 X |
| 3,049,283 | A | * | 8/1962 | Buttery et al. | 229/125.17 X |
| 3,204,849 | A | | 9/1965 | Vinney | |
| 3,285,496 | A | * | 11/1966 | Barnhardt, Sr. et al. | 229/125.17 X |
| 4,071,064 | A | * | 1/1978 | Saul | 229/125.28 X |
| 4,119,266 | A | * | 10/1978 | Dempster | 229/109 X |
| 4,264,031 | A | * | 4/1981 | Goebel | 229/125.17 X |
| 4,361,267 | A | * | 11/1982 | Wonznicki | 229/109 X |
| 4,392,607 | A | * | 7/1983 | Perkins, Jr. | 229/109 X |
| 4,736,885 | A | | 4/1988 | Negus, Sr. | |
| 4,816,631 | A | * | 3/1989 | Eeg et al. | 229/117.3 X |
| 4,886,164 | A | * | 12/1989 | Stein et al. | 229/125.17 X |
| 5,050,775 | A | * | 9/1991 | Marquartdt | 229/117.3 X |
| 5,096,073 | A | * | 3/1992 | O'Brien | 229/109 X |
| 5,474,203 | A | * | 12/1995 | Baker | 229/117.27 |
| 5,699,959 | A | * | 12/1997 | Huspeka et al. | 229/125.28 X |
| 5,749,489 | A | * | 5/1998 | Benner et al. | 229/117.3 X |
| 6,062,431 | A | * | 5/2000 | Geshay | 229/117.3 X |

* cited by examiner

*Primary Examiner*—Lee Young
*Assistant Examiner*—Tri M. Mai
(74) *Attorney, Agent, or Firm*—Bernstein & Associates, P.C.; Jason A. Bernstein

(57) ABSTRACT

A foldable container comprising a sheet of material having a plurality of panels hingedly connected together to permit folding thereof into a polygonal shape for storing liquid, solid or granular material. Male and female flaps are hingedly connected to the panels, and are foldable into an interlocked arrangement to form the container bottom. A lid can be provided having a lid panel and one or more lid flaps hingedly connected thereto. The lid flaps each have a lid opening and a handle portion, and the sheet has corresponding panel openings and handle portions. The lid flaps have locking tabs that can be extended through the aligned lid and panel openings to secure the lid in place.

11 Claims, 8 Drawing Sheets

FOLDABLE STORAGE CONTAINER

FIELD OF THE INVENTION

The present invention relates generally to storage and shipping containers and, more particularly, to a foldable container formed from one or more foldable panels with foldable flaps.

BRIEF DESCRIPTION OF THE PRIOR ART

Dry materials such as powdered, granulated, or pelletized chemicals are commonly used in many industrial and commercial applications. Such materials are typically shipped to a location for use and stored on-site until needed. The materials are commonly stored and shipped in generally rigid containers made of metal. Metal containers are generally strong and durable to prevent leakage of the materials, but are generally heavy and thus difficult to handle and more costly to ship.

There are known in the art a number of generally lightweight, foldable containers for general use. U.S. Pat. No. 2,771,851 to Rabby discloses a two-piece container for carrying heavy loads. The container is hexagonal and has a bottom formed by flaps that extend downward from the container sides and are foldable across the open bottom of the container. The container sides have register slots at lower portions thereof through which extensions of the bottom flaps can pass. The extensions can be folded to form saddles to retain the extensions in place.

U.S. Pat. No. 2,736,485 to Rabby discloses a box with a readily attachable end closure. A hexagonal container has sides forming open lower and upper ends with vertical slots in the sides near the lower and upper ends. A bottom end closure wall and a top end closure wall each have flaps connected thereto, each flap having a height sufficient to fold around one of the container ends and along the outside of the container sides to the slots. Securing tabs extend from the flaps, and locking tabs extend from the securing tabs, with the locking tabs and securing tabs sized to pass through the vertical slots, and the locking tabs lock the flap in place.

U.S. Pat. No. 518,898 to Schmidt discloses a tubular paper box. The box has two opposing hexagonal flaps extending from and foldable over each box end. Four tetragonal flaps extend from and can be folded over each end, with two of the tetragonal flaps positioned on either side of each hexagonal flap.

U.S. Pat. No. 4,736,885 to Negus, Sr. discloses a polygonal bulk container having a polygonal bottom panel that is folded over the open bottom of the container. The polygonal bottom panel is glued to a reinforcing square tab and a web construction having tabs and extensions.

U.S. Pat. No. 1,585,505 to Mclndoe discloses a carton comprising a body part with a foldable top end flap extending from an upper portion thereof and a foldable bottom end flap extending from a lower portion thereof. A plurality of projection flaps extend from the body part and the ends such that they can be folded over the ends for reinforcement of the carton.

U.S. Pat. No. 1,497,671 to Crowell discloses a fiber corrugated board barrel formed from a single piece of corrugated board folded at creases in the board into a hexagonal or octagonal shape. The bottom has edge flanges and connector strips for securing to the barrel.

U.S. Pat. No. 3,204,849 to Vinney discloses a hexagonal, corrugated shipping container comprising six panels folded into a hexagonal shape. Top and bottom closure members have tabs for securing to the panels.

Foldable containers provide the advantage of being lightweight and generally easier and more efficient to handle and ship, as well as requiring less storage space when in the folded configuration. None of these foldable containers, however, have proven entirely suitable for storing and shipping materials such as powdered chemicals.

Accordingly, what is needed but not found in the prior art is a container that is strong and durable to prevent leakage of the materials, yet lightweight for ease and efficiency in handling and shipping, and foldable for requiring less storage space when in the folded configuration.

SUMMARY OF THE INVENTION

Generally described, the present invention provides a container having a foldable sheet of material and a lid. The sheet has a plurality of panels that are hingedly connected together to permit folding thereof into a polygonal shape. In a preferred embodiment, eight regular panels and an overlap panel can be provided that are foldable into an octagonal shape.

The sheet has at least one and preferably two male flaps each hingedly connected to at least one of the panels. The male flaps have a head portion and a neck portion. The sheet also has at least one and preferably two female flaps each hingedly connected to at least one of the panels. The female flaps have ends with at least one and preferably two slots in each of the ends. The sheet may further have at least one and preferably four intermediate flaps each hingedly connected to one of the panels interposed between one of the male flaps and one of the female flaps.

To form the container, the sheet is folded into the polygonal shape, with the panels thereby forming the sides of the container. The intermediate flaps are folded over the open bottom end of the container, then the female flaps are folded over the intermediate flaps. The male flaps are then folded over female flaps and extended through the female flap slots, with the male flaps head portions interlocked with the slots.

Turning now to the top of the container, at least one and preferably four of the panels have a panel opening, with the portion of the panels between the panel opening and the panel ends forming a panel handle portion. The lid has a lid panel and at least one and preferably four lid flaps hingedly connected thereto.

Each of the lid flaps has a first section hingedly connected to the lid panel, with each first section having a lid opening defined therein and a lid handle portion adjacent the opening. Second, third, and fourth sections can be provided and hingedly connected together. Each of the lid flaps has an end section hingedly connected to the fourth section. Each end section has a main portion and at least one locking tab hingedly connected thereto. The end section can be extended through the aligned panel and lid openings only when the locking tab is folded over the main portion.

To assemble the lid onto the folded sheet to form the container, the lid flaps and the locking tabs are folded up and the lid panel is inserted into the folded sheet so that the panel and lid openings are aligned. The second and third sections are then folded over and down the folded sheet, the end section is inserted through the aligned openings, and the locking tabs are unfolded. The lid is now securely attached to the folded sheet to form the container. The container can be picked up and otherwise handled by using the aligned handle portions and the aligned openings as handles.

These and other objects, features, and advantages of the present invention are discussed or apparent in the following detailed description of the invention, in conjunction with the accompanying drawings and the appended claims.

BRIEF DESCRIPTION OF THE DRAWINGS

The various features and advantages of the invention will be apparent from the attached drawings, in which like reference characters designate the same or similar parts throughout the figures, and in which.

DETAILED DESCRIPTION OF THE PREFERRED EMBODIMENT

Figure 1:
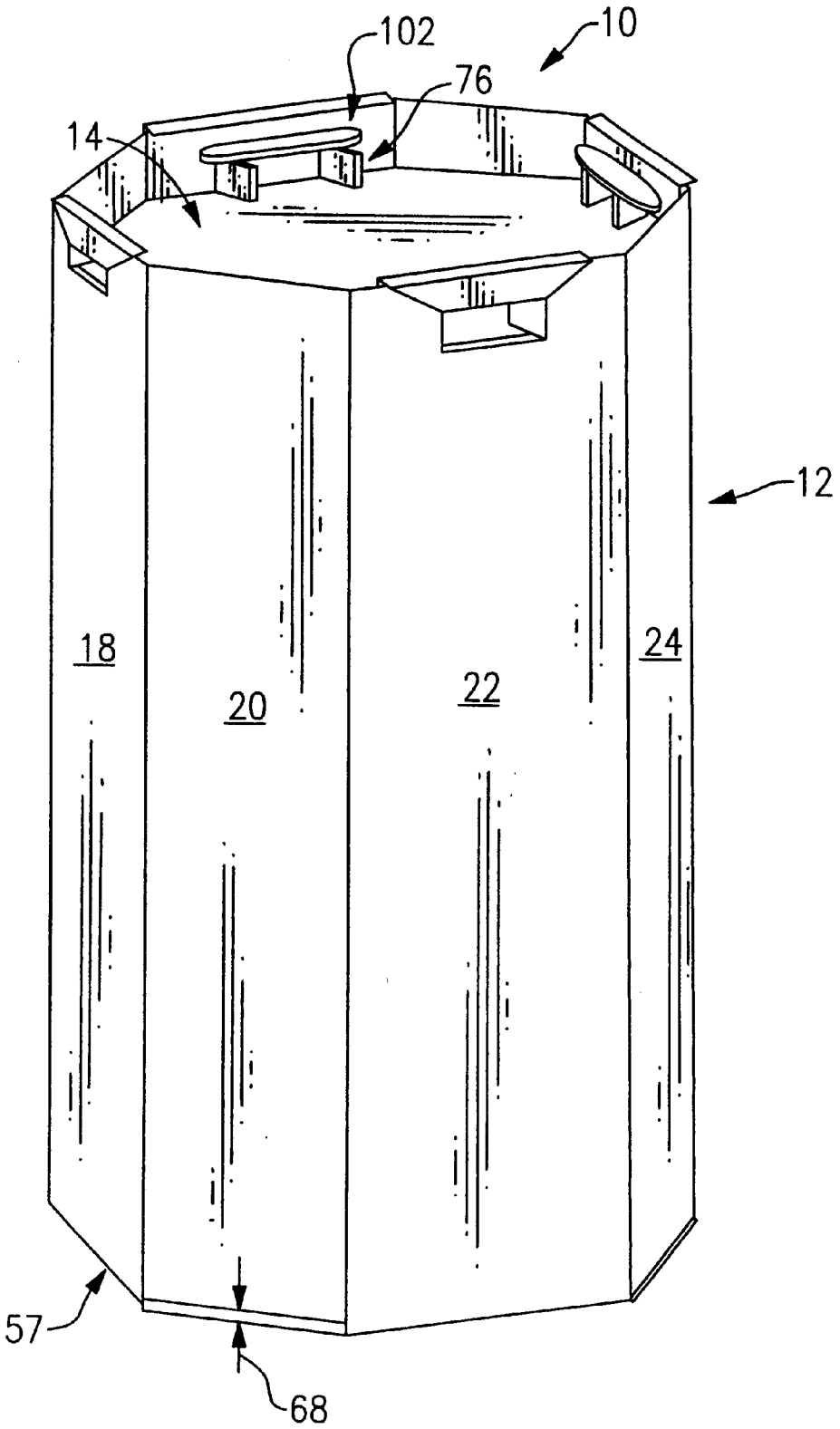
FIG. 1 is a perspective view of the present container invention.

Referring now to FIG. 1, there is illustrated a first preferred embodiment of the present invention, referred to generally as the container 10. The container 10 comprises a foldable sheet 12 of material and a lid 14. The sheet 12 can be folded into a polygonal shape or into a generally flat arrangement. The sheet 12 and lid 14 are preferably made of a corrugated paperboard, plastic, metal with hinges or portions that can flex, plastic corrugated, paper, or other generally rigid material known in the art, preferably light in weight and having sufficient strength to contain the intended weight of contents. This material choice may change depending on the nature of the contents. By way of illustration, but not limitation, the material may be coated, waterproofed impregnated (e.g., with wax), reinforced, laminated, or treated to have desired properties. Such properties may include, but are not limited to, corrosive resistant, flame, heat, moisture and/or acid/alkaline resistant, cut or puncture resistant, high burst strength, or the like.

Figure 2:
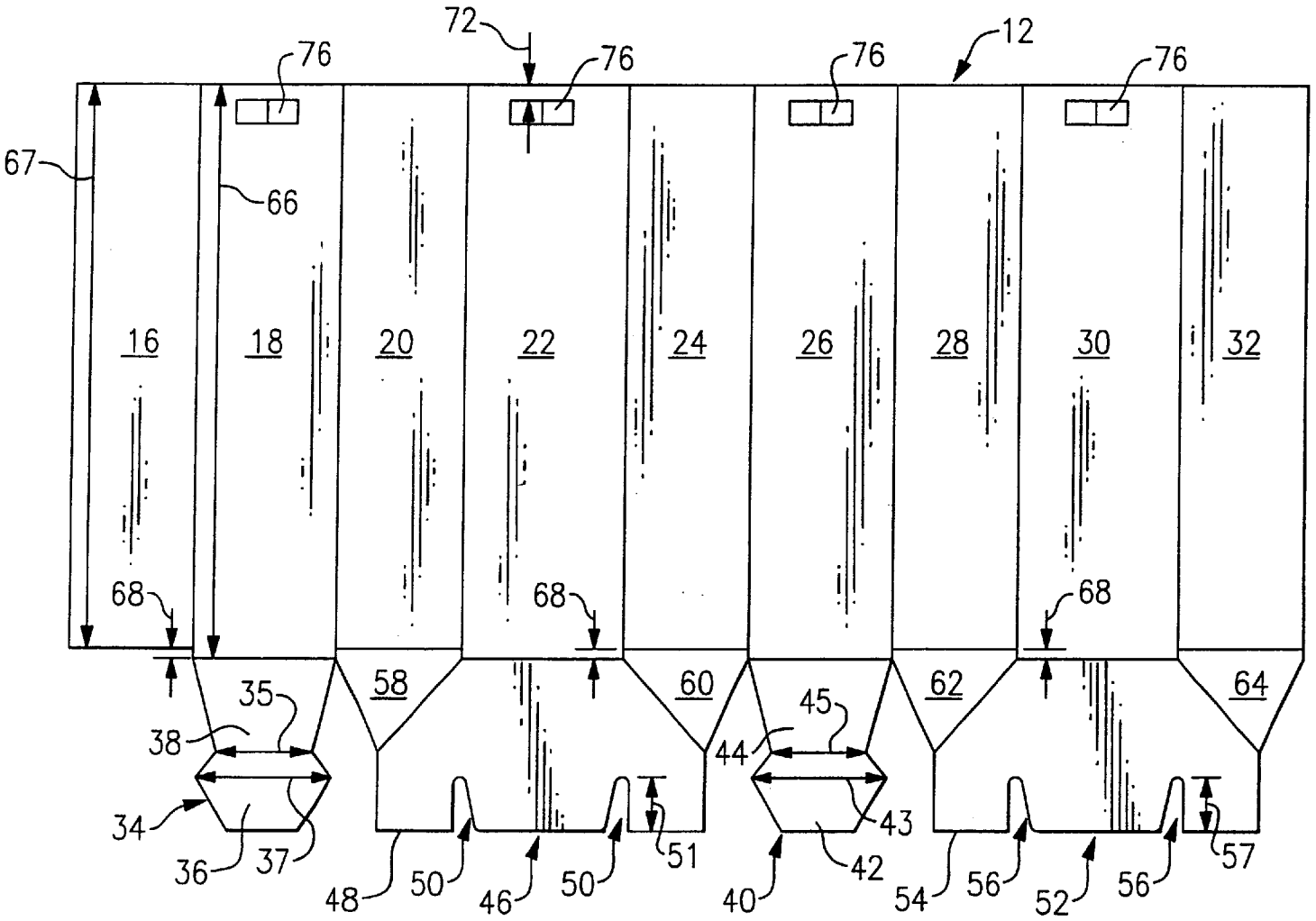
FIG. 2 is a plan view of a sheet of the container in an unfolded configuration.

Referring now to FIG. 2, the sheet 12 has a plurality of panels that are hingedly connected together to permit folding thereof. For example, eight regular panels 18, 20, 22, 24, 26, 28, 30, and 32 (referred to hereinafter as the "panels 18–32") and an overlap panel 16 can be provided that are foldable into an octagonal shape. It will be understood that other numbers of panels can be provided for forming different shaped containers as may be desired in a given application. The sheet panels 18–32 preferably have a generally rectangular shape, although other regular or irregular shapes may be used.

The sheet 12 has at least one and preferably two male flaps 34 and 40 each hingedly connected to at least one of the panels 18-32. The male flaps 34 and 40 have a head portion 36 and 42 and a neck portion 38 and 44 between the head portion 36 and 42 and the corresponding panel 18-32. The head portions 36 and 42 have a width 37 and 43, and the neck portions 38 and 44 have a width 35 and 45.

The sheet 12 also has at least one and preferably two female flaps 46 and 52 each hingedly connected to at least one of the panels 18–32. The female flaps 46 and 52 have ends 48 and 54 with at least one and preferably two slots 50 and 56 defined in each of the ends 48 and 54. Each of the slots 50 and 56 has a depth that is at least one half of the width 35 and 45 of the male flap neck portions 38 and 44 and no more than one half of a width 37 and 43 of the male flap head portions 36 and 42. It will be understood that the multiple the female flap slots 50 and 56 can all have the same or different widths, the multiple male flap head portions 36 and 42 can all have the same or different widths, and the multiple male flap neck portions 38 and 44 can all have the same or different widths. The female flaps 46 and 52 preferably have a semi-octagonal shape, that is, about one half of an octagon, although other regular or irregular shapes may be provided.

The male flaps 34 and 40 and the female flaps 46 and 52 are preferably alternately arranged so that one of the male flaps 34 and 40 is disposed between the two female flaps 46 and 52. Additionally, the male flaps 34 and 40 and the female flaps 46 and 52 are preferably connected to alternate panels 18–32, so that when the panels 18–32 are folded into the octagonal shape then the male flaps 34 and 40 are oppositely arranged from each other and the female flaps 46 and 52 are oppositely arranged from each other.

The sheet 12 may further have at least one and preferably four intermediate flaps 58, 60, 62, and 64 (referred to hereinafter as the"intermediate flaps 58–64") each hingedly connected to one of the panels 18–32. Each of the intermediate flaps 58–60 is preferably interposed between one of the male flaps 34 and 40 and one of the female flaps 46 and 52. Preferably, the panels 20, 24, 28 and 30 having intermediate flaps 58–64 connected thereto have a first length 66, the panels 18, 22, 26, and 30 having male flaps 34 and 40 and female flaps 46 and 52 connected thereto have a second length 67, and the first length 66 is less than the second length 67 by an offset amount 68 that is substantially the same as a thickness 77 of the sheet 12 (see FIG. 8). Thus, the intermediate flaps 58–64 can be folded over to provide additional strength for the container 10, and the male flaps 34 and 40 and the female flaps 46 and 52 can be folded over the intermediate flaps 58–64 in a generally flat arrangement. It will be understood, however, that the container 10 can be suitably provided without the intermediate flaps 58–64.

Figure 3:
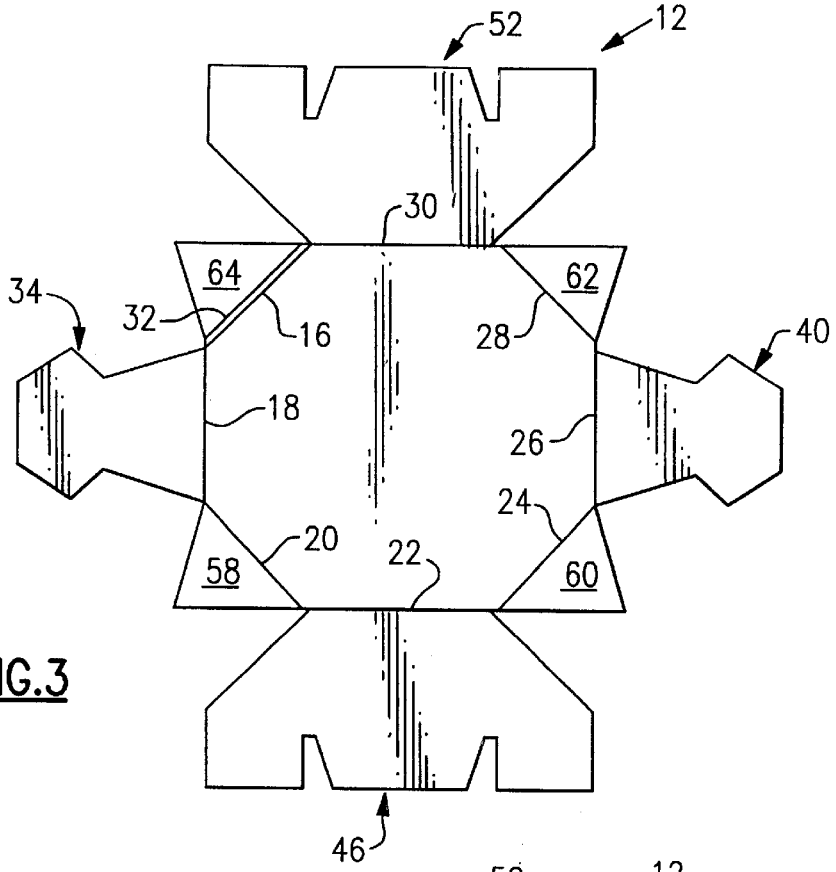
FIGS. 3–6 are bottom plan views showing the folding assembly of the bottom flaps of the container.

Referring now to FIGS. 3–6, there are illustrated the steps for folding the sheet 12 to form the container 10. As shown in FIG. 3, the sheet 12 is folded so that the overlap panel 16 overlaps with the end panel 32, the panels 18–32 thereby forming the sides of the container 10. The overlap flap 16 can be secured to the end panel 32 by glue or another adherent, staples, or other fasteners known in the art. It will be understood that the sheet 12 can be provided without the overlap panel 16 and the end panels can be fastened together directly, if so desired.

Figure 4:
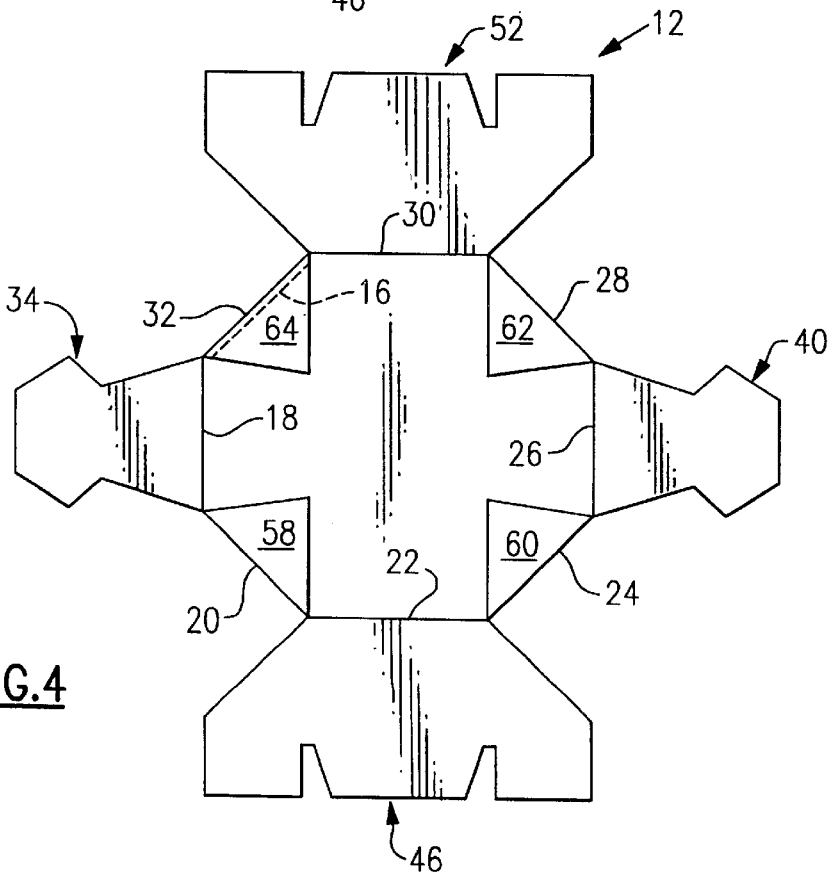
Figure 5:
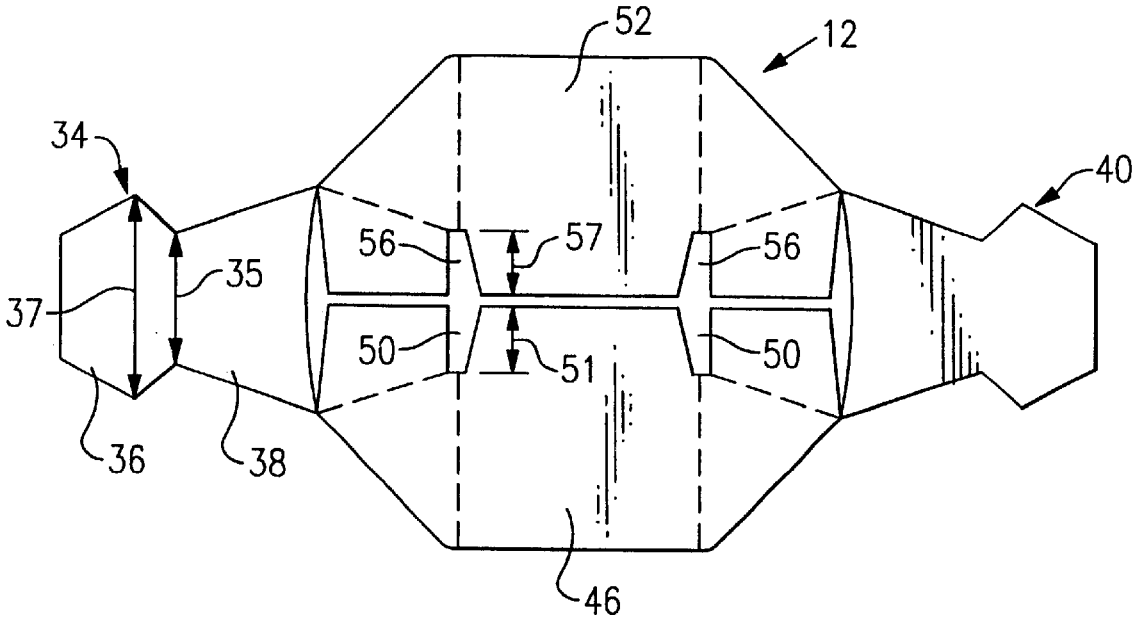
Figure 6:
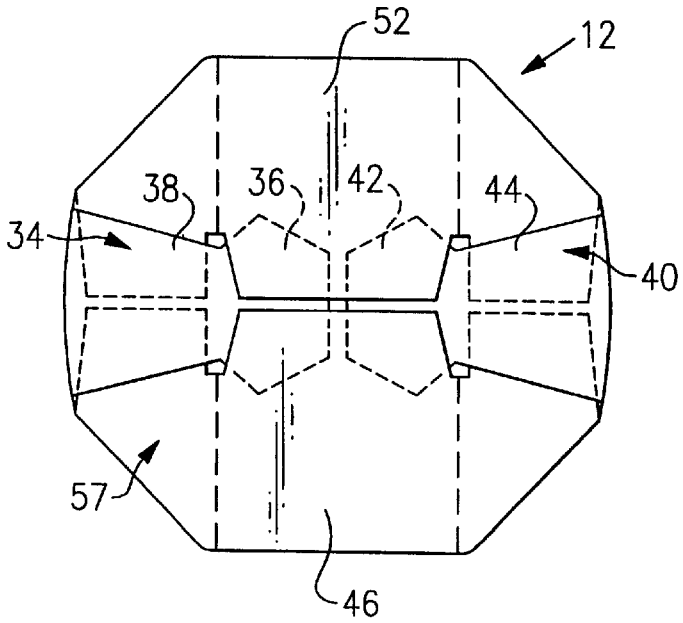
Figure 7:
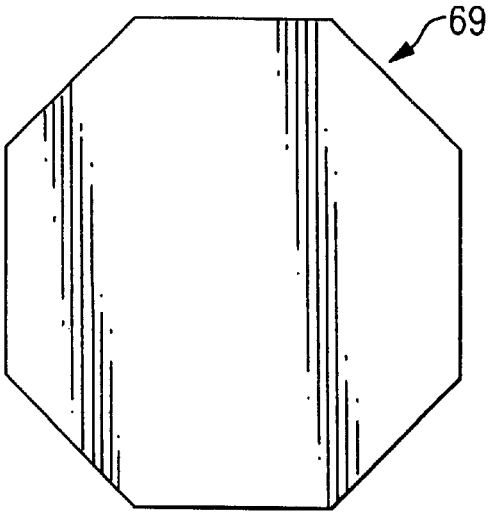
FIG. 7 is a plan view of a bottom panel of the container.

As shown in FIG. 4, the intermediate flaps 58–64 are folded over the open bottom end of the container 10. As shown in FIG. 5, the female flaps 46 and 52 are then folded over the intermediate flaps 58–64. As shown in FIG. 6, the male flaps 34 and 40 are then folded over female flaps 46 and 52 and extended through the female flap slots 50 and 56, with the male flaps head portions interlocked with the slots. The male flap heads 36 and 42 are thus disposed generally within the container 10 and the male flap necks 38 and 44 are disposed generally outside the container 10. The intermediate flaps 58–64, male flaps 34 and 40, and female flaps 46 and 52 are thus foldable and interlockable to form a container bottom 57 (see FIG. 1). Referring to FIG. 7, a bottom panel insert 69 may be inserted into the container 10 and disposed above the folded intermediate flaps 58–64, male flaps 34 and 40, and female flaps 46 and 52 for providing added strength.

Figure 8:
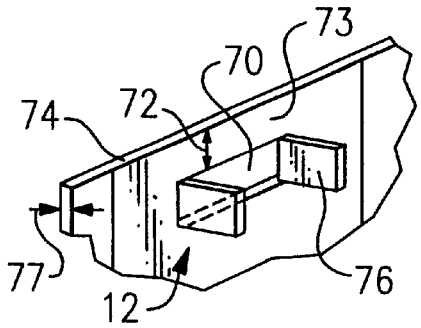
FIG. 8 is a detail perspective view of an opening in a panel of the sheet of the container.

Turning now to the top of the container 10, and referring now to FIG. 8, at least one and preferably four of the panels 18–32 have a panel opening 70 defined therein. The portion of the panels 18–32 between the panel opening 70 and the panel ends 74 forms a panel handle portion 73 having a width 72. The panel openings 70 may be provided with foldable panel opening flaps 76, as may be desired.

Figure 9:
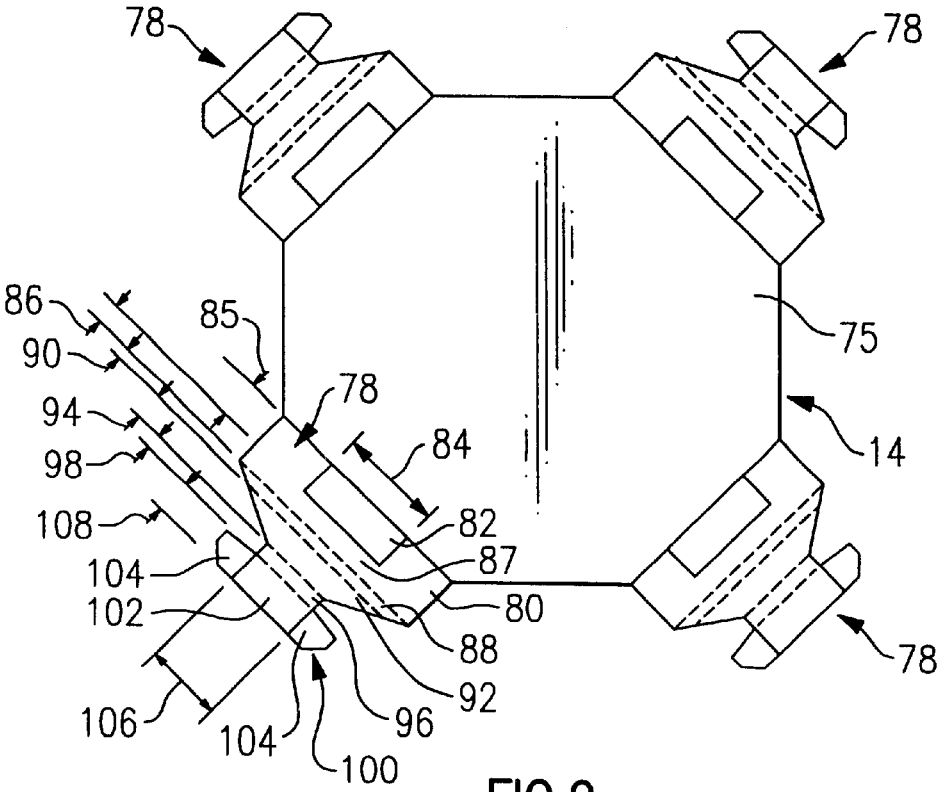
FIG. 9 is a top plan view of the lid of the container.

Referring now to FIG. 9, the lid 14 has a lid panel 75 and at least one lid flap 78 hingedly connected thereto. The number of lid flaps 78 may correspond to the number of panel openings 70, so, for example, four lid flaps 78 may be provided. The lid 14 has a thickness 79 (see FIG. 10), and the lid panel 75 is sized and shaped to be received within the folded sheet 12. Thus, the lid panel 75 may have a shape corresponding to the shape of the folded sheet 12, so, for example, the lid panel 75 may have an octagonal shape.

Each of the lid flaps 78 has a first section 80 hingedly connected to the lid panel 75. Each first section 80 has a lid opening 82 defined therein and a lid handle portion 87 adjacent the opening 82. Each lid opening 82 has a length 84 and a width 85. Each lid handle portion 87 has a width 86 that is substantially the same as the width 72 of the panel handle portion 87, wherein the lid opening 70 can be aligned with the panel opening 82 and the lid handle portion 87 can be aligned with the panel handle portion 87.

Each of the lid flaps 78 has a second section 88 hingedly connected to the first section 80, with the second section 88 having a width 90 that is preferably substantially the same as the sheet thickness 77. Each of the lid flaps 78 has a third section 92 hingedly connected to the second section 88, with the third section 92 having a width 94 that is preferably substantially the same as the width 79 of the lid handle portion 87. Each of the lid flaps 78 has a fourth section 96 hingedly connected to the third section 92, with the fourth section 96 having a width 98 that is preferably substantially the same as the sheet thickness 77 and the lid thickness 79 combined.

Each of the lid flaps 78 has an end section 100 hingedly connected to the fourth section 96. Each end section 100 has a main portion 102 and at least one locking tab 104 hingedly connected thereto. Each main portion 102 of the lid end section 100 has a length 106 that is substantially the same as or less than the length 84 of the lid opening 82, and a width 108 that is substantially the same as or less than the width 85 of the lid opening 82, so that the end section 100 can be extended through the panel opening 70 and the lid opening 82 only when the locking tab 104 is folded over the main portion 102.

Figure 10:
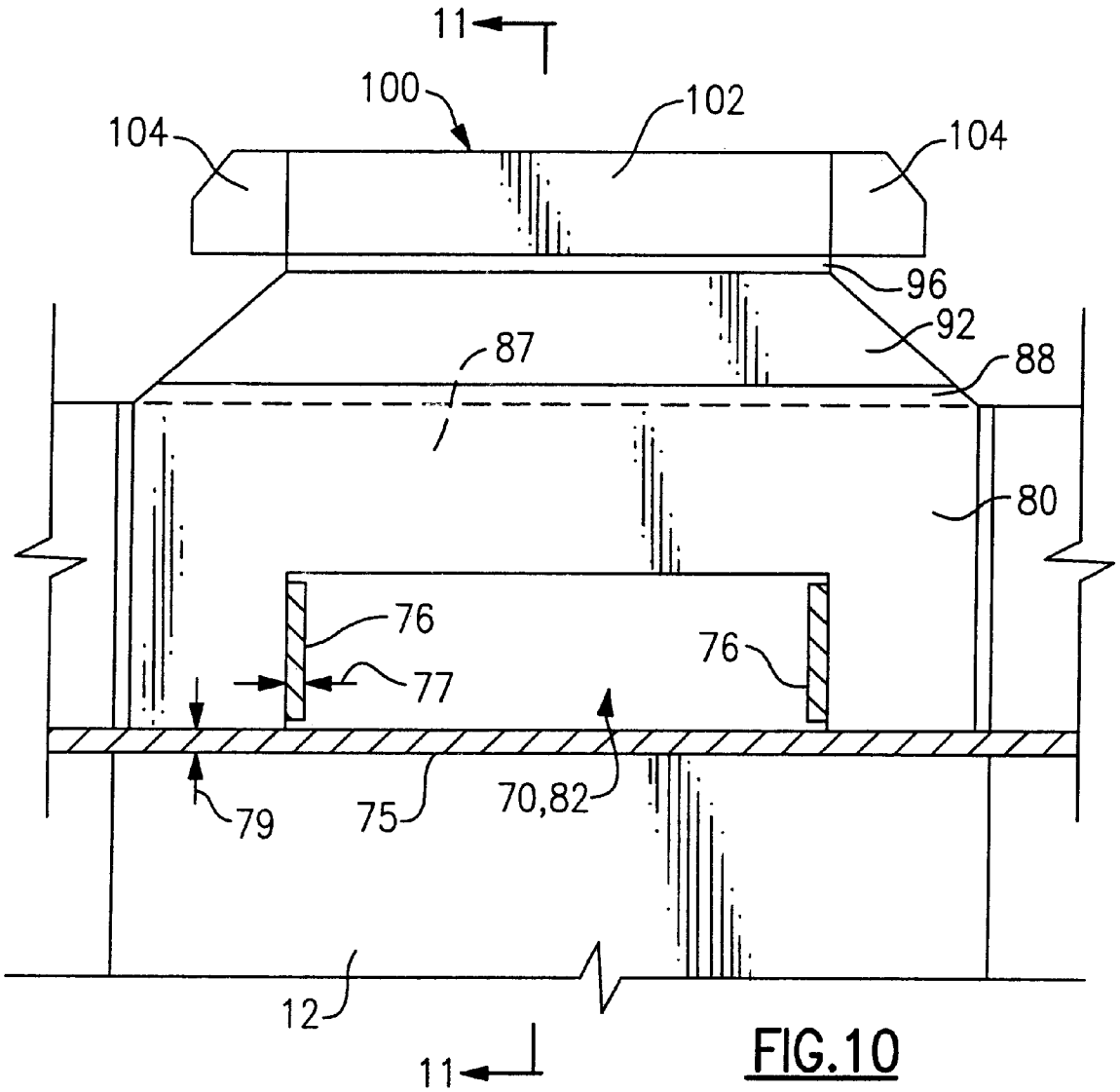
FIG. 10 is a detail side view of the lid being assembled on the container.
Figure 11:
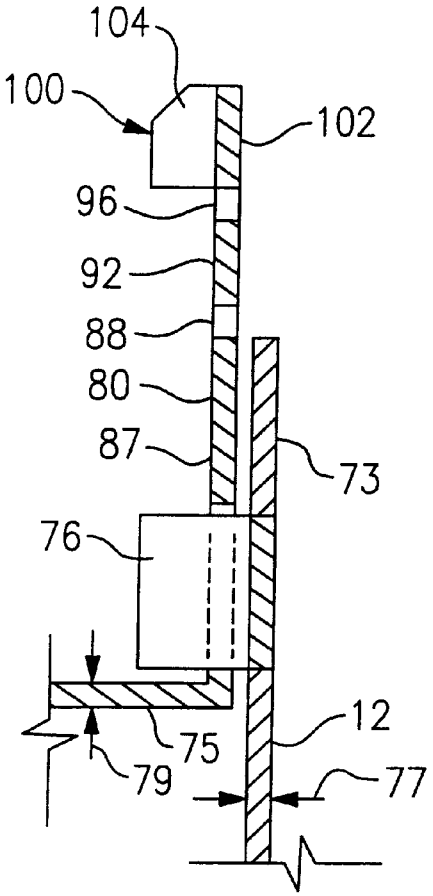
FIG. 11 is a cross-section view taken at line A—A of FIG. 10.
Figure 12:
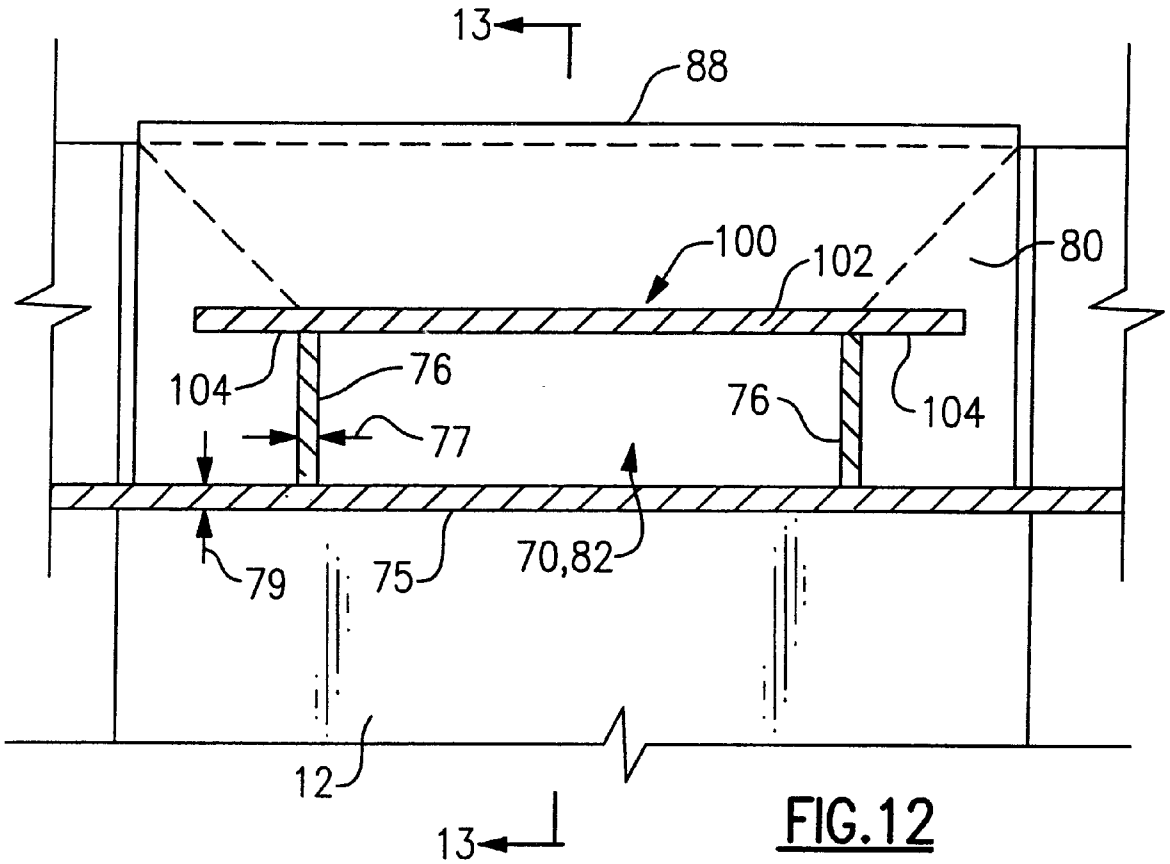
FIG. 12 is a detail side view of the lid fully assembled on the container.
Figure 13:
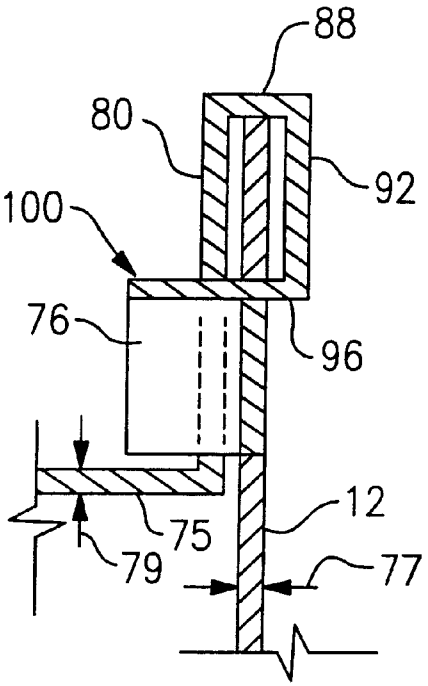
FIG. 13 is a cross-section view taken at line A—A of FIG. 12.

Referring now to FIGS. 10–12, there are illustrated the steps for folding and assembling the lid 14 onto the folded sheet 12 to form the container 10. As shown in FIGS. 10 and 11, the lid flaps 78 and the locking tabs 104 are folded up and the lid panel 75 is inserted into the folded sheet 12 so that the panel openings 70 and the lid openings 82 are aligned. As shown in FIGS. 12 and 13, the second section 88 and the third section 92 are then folded over and down the folded sheet 12, the end section is inserted through the aligned openings 70 and 82, and the locking tabs 104 are unfolded.

The lid 14 is now securely attached to the folded sheet 12 to form the container 10. The container 10 can be picked up and otherwise handled by using the aligned handle portions 73 and 87 and the aligned openings 70 and 82 as handles. The container 10 is thereby strong and durable to prevent leakage of the materials, yet lightweight for ease and efficiency in handling and shipping, and foldable for requiring less storage space when in the folded configuration.

It will be understood that the container 10 can be provided with the bottom 57 described herein and another lid, with the lid 14 described herein and another bottom, or with both the lid 14 and the bottom 57. It will be further understood that the lid 14 arrangement can be used as a bottom, and the bottom arrangement can be used as a lid.

Figure 14:
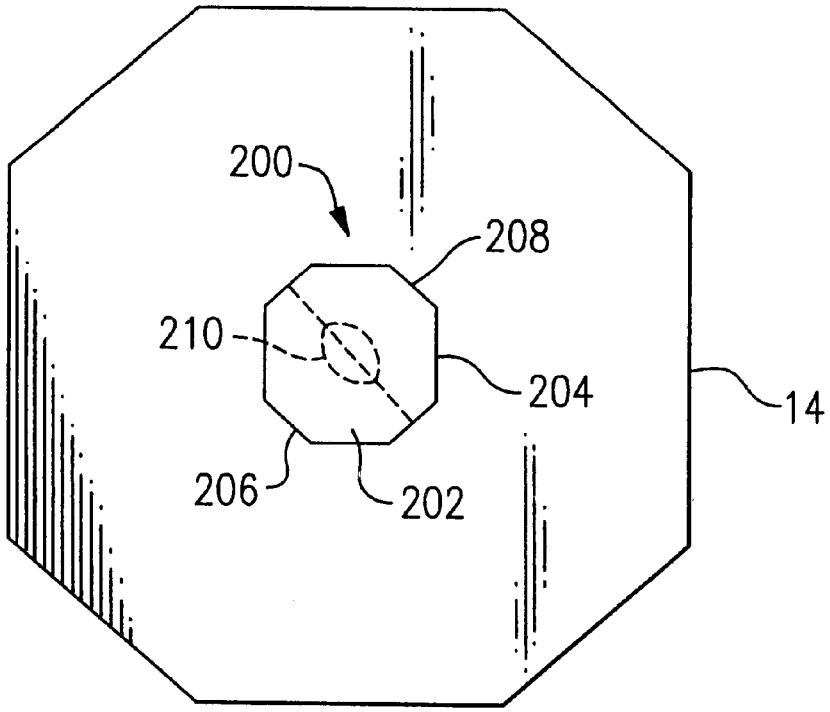
FIG. 14 is a top plan view of the lid of an alternative embodiment of the present invention.

In an alternative embodiment, shown in FIG. 14, there is an access port 200 in the lid 14 for providing access to the contents without having to remove the lid 14. The access port 200 comprises a first flap 202 and a second flap 204. Sides 206 and 208 are not cut all the way through to provide a hinge to each flap. The remaining sides are cut. The center line 210 is cut and nicked to provide a frangible line that can be broken when access is desired. Alternatively, the sides 206 and 208 can be scored to create more flexible hinges. Variations on this access port 200 are contemplated as being within the scope of the present invention; for example, the shape of the port 200 can be square, hexagonal, octagonal or other shape. There can also be more than one port 200 on the lid 14 or the port(s) can be cut in the bottom panel 69. The port 200 can alternatively comprise a single flap with one side being hinged and the remaining sides being cut and/or nicked. Optionally, a notch 210 can be cut and/or nicked in at least one flap to facilitate the user opening the flap 200 with one's fingers or an implement. The user can punch out the notch 210 and lift the flap(s).

Alternatively, at least one port 200 can be created in one or more of the panels 18 et seq. For example, a port 200 can be created in a panel 18 at the bottom so that access to fluids within the container can be obtained. Any number of ports 200 can be created depending on the needs of the user of the container of the present invention.

Figure 15:
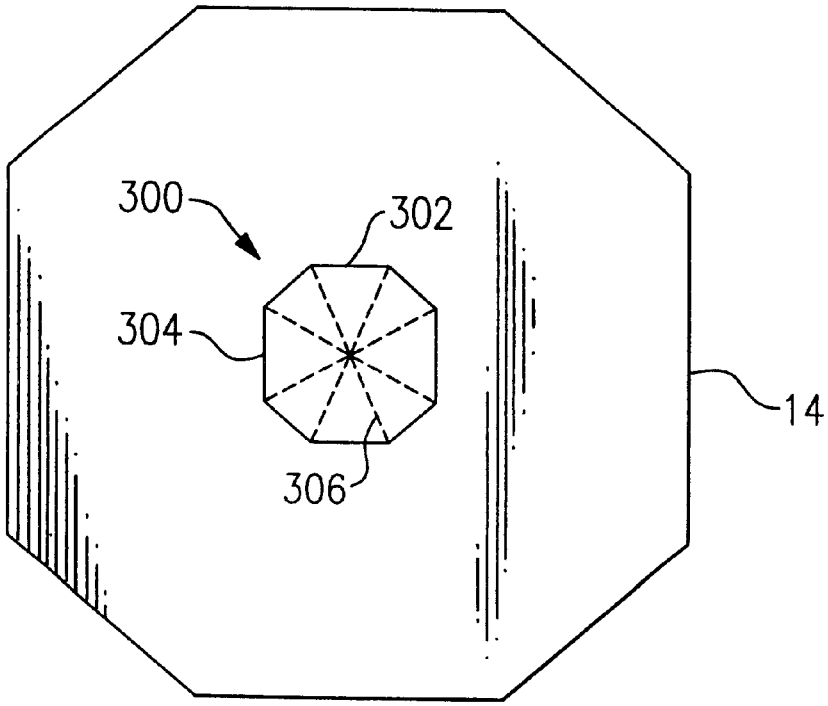
FIG. 15 is a top plan view of the lid of another alternative embodiment of the present invention.

Also, a port 300, as shown in FIG. 15, can comprise more than two flaps, for example, but not by way of limitation, there can be three or more flaps 302, defined in the lid 14 (or one or more panels 18 et seq.) with appropriate hinged sides 304 and cut (and/or nicked) portions 306.

The present invention presents several distinct advantages over the prior art. One advantage of the present invention is the lower weight of the container (compared to conventional drums) while maintaining desirable strength properties. The low tare weight translates into lower shipping costs. Fiber drums must be shipped set up. Approximately 320 standard fiber drums can be shipped in a typical truck. Since the container of the present invention can be broken down and stored flat, it takes up far less space than conventional drum containers and therefore permits more units (in the range of about 4,500) to be stored or shipped in a given volume. This translates into far greater transporting efficiency and shipping cost reduction. The container of the present invention is recyclable. Currently available drums are typically of fiber or metal construction, which are hard to dispose of. The shape of the container of the present invention (octagonal in a preferred embodiment) allows a handler to roll it on the floor (typically where the user tips the container at an angle and uses the handles for manipulating it), similar to a fiber drum. The container of the present invention has a geometric axial cross section with sides preferably angled at more than 90°, bulging is reduced when the container is filled.

While the invention has been described in connection with certain preferred embodiments, it is not intended to limit the scope of the invention to the particular forms set forth, but, on the contrary, it is intended to cover such alternatives, modifications, and equivalents as may be included within the true spirit and scope of the invention as defined by the appended claims. The terms "a," "an," and "one" as used herein are not intended to mean only"one," but may also mean a number greater than"one." Any patents, applications or publications referred to herein are hereby incorporated by reference in their entirety.

What is claimed is:

1. A container, comprising:

a) a sheet of material having a plurality of panels hingedly connected together and foldable into a polygonal shape, at least one of said panels having a panel opening defined therein and a panel handle portion adjacent said opening;

b) a lid having a lid panel and at least one lid flap hingedly connected thereto, wherein said lid panel is sized to be received within said polygonal folded sheet;

c) said lid flap having a first section hingedly connected to said lid panel, said first section having a lid opening defined therein and a lid handle portion adjacent said opening, wherein said lid opening can be aligned with said panel opening and said lid handle portion can be aligned with said panel handle portion; and d) said lid flap having an end section hingedly connected to said first section, said end section having a main portion and at least one locking tab extending therefrom and hingedly connected thereto, wherein said end section can be extended through said panel opening and said lid opening only when said locking tab is folded over said main portion.

2. The container of claim 1, wherein said at least one lid flap comprises four lid flaps.

3. The container of claim 1, wherein said at least one lid panel has an octagonal shape.

4. The container of claim 1, wherein said lid opening has a width and said main portion of said lid end section has a width that is substantially the same as or less than said width of said lid opening.

5. The container of claim 1, wherein said lid opening has a length and said main portion of said lid end section has a length that is substantially the same as or less than said length of said lid opening.

6. The container of claim 1, wherein:

a) said sheet has a thickness and said lid has a thickness;

b) said panel handle portion has a width and said lid handle portion has a width that is substantially the same as said width of said panel handle portion;

c) said lip flap has a second section hingedly connected to said first section, said second section having a width that is substantially the same as said thickness of said sheet;

d) said lip flap has a third section hingedly connected to said second section, said third section having a width that is substantially the same as said width of said lid handle portion; and e) said lip flap has a fourth section hingedly connected to said third section, said fourth section having a width that is substantially the same as said thickness of said sheet and said thickness of said lip combined;

f) such that said end section is hingedly connected to said fourth section.

7. A container, comprising:

a) a sheet of material having nine panels hingedly connected together and foldable into an octagonal shape, four of said panels having a panel opening defined therein and a panel handle portion adjacent sad opening, wherein said sheet has a thickness and said panel handle portion has a width;

b) said sheet having two male flaps each hingedly connected to at least one of said panels, each of said male flaps having a head portion and a neck portion between said head portion and said panel;

c) said sheet having two female flaps each hingedly connected to at least one of said panels, each of said female flaps having a semi-octagonal shape with an end and two slots defined in said end, each of said slots having a depth that is at least one half of a width of said neck portion of said male flap and no more than one half of a width of said head portion of said male flap;

d) wherein said male flaps and said female flaps are alternately arranged so that one of said male flaps is disposed between said two female flaps, and said male flaps and said female flaps extend from alternate panels so that when said panels are folded into said octagonal shape then said male flaps are oppositely-arranged and said female flaps are oppositely arranged;

e) wherein said male flaps and said female flaps are capable of being folded to form a container bottom with each said male flap head extending through at least one of said female flap slots;

f) said sheet having one or more intermediate flaps each hingedly connected to one of said panels, each of said intermediate flaps interposed between one of said male flaps and one of said female flaps, wherein said intermediate flaps have a first length, said panels having male flaps and female flaps connected thereto have a second length, and said first length is less than said second length by an offset amount that is substantially the same as said thickness of said sheet, wherein said male flaps and said female flaps can be folded over said intermediate flaps in a generally flat arrangement;

g) a lid having a lid panel and four lid flaps hingedly connected thereto, wherein said lid panel has an octagonal shape and is sized to be received within said octagonal folded sheet, wherein said lid has a thickness;

h) each of said lid flaps having a first section hingedly connected to said lid panel, said first section having a lid opening defined therein and a lid handle portion adjacent said opening, wherein said lid handle portion has a width that is substantially the same as said width of said panel handle portion, wherein said lid opening can be aligned with said panel opening and said lid handle portion can be aligned with said panel handle portion, i) each of said lid flaps having a second section hingedly connected to said first section, said second section having a width that is substantially the same as said thickness of said sheet;

j) each of said lid flaps having a third section hingedly connected to said second section, said third section having a width that is substantially the same as said width of said lid handle portion;

k) each of said lid flaps having a fourth section hingedly connected to said third section, said fourth section having a width that is substantially the same as said thickness of said sheet and said thickness of said lip combined; and l) each of said lid flaps having an end section hingedly connected to said fourth section, said end section having a main portion and at least one locking tab extending therefrom and hingedly connected thereto;

wherein said lid opening has a width and said main portion of said lid end section has a width that is substantially the same as or less than said width of said lid opening, and said lid opening has a length and said main portion of said lid end section has a length that is substantially the same as or less than said length of said lid opening; wherein said end section can be extended through said panel opening and said lid opening only when said locking tab is folded over said main portion.

8. The container of claim 7, wherein said sheet is made of a corrugated paper board.

9. The container of claim 7, wherein said panels each have a generally rectangular shape.

10. The container of claim 7, wherein said male flap heads are disposed generally within said container and said male flap necks are disposed generally outside said container when said flaps are folded to form said container bottom.

11. The container of claim 7, wherein said sheet is foldable into a generally flat arrangement.

* * * * *